US006412388B1

(12) United States Patent
Frazier

(10) Patent No.: US 6,412,388 B1
(45) Date of Patent: Jul. 2, 2002

(54) SAFETY ARMING DEVICE AND METHOD, FOR PERFORATION GUNS AND SIMILAR DEVICES

(76) Inventor: Lynn Frazier, 5353 County Rd. 73, Robstown, TX (US) 78380

( * ) Notice: Subject to any disclaimer, the term of this patent is extended or adjusted under 35 U.S.C. 154(b) by 0 days.

(21) Appl. No.: 09/688,980

(22) Filed: Oct. 17, 2000

Related U.S. Application Data

(60) Provisional application No. 60/160,379, filed on Oct. 19, 1999.

(51) Int. Cl.[7] ..... F42D 5/00

(52) U.S. Cl. ..... 89/1.15; 102/312; 102/313

(58) Field of Search ..... 89/1.15; 102/202.1, 102/202.12, 222, 206, 312, 313; 175/2, 4.56, 4.57

(56) References Cited

U.S. PATENT DOCUMENTS 4,011,815 A * 3/1977 Garcia ..... 166/55.1
4,319,526 A * 3/1982 DerMott ..... 102/202.1
5,027,708 A * 7/1991 Gonzalez et al. ..... 102/202.1
5,159,145 A * 10/1992 Carisella et al. ..... 102/222
6,339,992 B1 * 1/2002 Watson ..... 102/302

* cited by examiner

*Primary Examiner*—Peter M. Poon
*Assistant Examiner*—Gabriel S Sukman
(74) *Attorney, Agent, or Firm*—John C. Hunt; Blake, Cassels & Graydon LLP

(57) ABSTRACT

Safety arming device for an underground well tool having an explosive charge contained in a housing. The device includes a hollow member for connection at an end of the housing, the member having an outer wall which defines a window to permit lateral insertion therethrough of a detonator into an operable position in the member when the member is connected to the housing. There is a closure member for mounting on the hollow member in sealing engagement therewith, so as to preclude ingress of liquids into the member through the window.

34 Claims, 7 Drawing Sheets

10
12
14
16
18
19a
19b
20
22
46
48

SAFETY ARMING DEVICE AND METHOD, FOR PERFORATION GUNS AND SIMILAR DEVICES

This application claims priority from U.S. Provisional Patent Application Serial No. 60/160,379 filed on the Oct. 19, 1999.

FIELD OF THE INVENTION

This invention is related to a safety arming device for use as part of an apparatus for perforating oil wells, etc. and to methods of providing an armed device. More particularly, the invention is related to a detonator assembly for initiating perforating charges in an underground perforating gun.

BACKGROUND OF THE INVENTION

Underground perforating guns are used in the production of oil and gas for provision of perforations through an oil well casing and into a hydrocarbon producing formation to provide access from the formation into the wellbore such that oil and gas may be produced.

After the oil well has been drilled, a steel casing is lowered into the wellbore and cemented into place to protect the wellbore and to prevent migration of formation fluid from one formation to another.

A perforating gun is then lowered into the steel casing and perforations are made at a desired spacing through the steel liner and into the formation such that hydrocarbons in the desired formation may flow into the oil wellbore and from there be produced to the surface.

An electrically-actuated or so-called "electric" detonator (initiator) is typically employed for operating the explosive charges on a perforating gun. In a typical arrangement, a gun is dependently supported in a wellbore by a so-called wireline (suspension) cable which has electrical conductors connected to a surface power source. The electric detonators that are most commonly used on oilfield well tools have a fluid-tight hollow shell in which is encapsulated an ignitor charge (such as a black powder or an ignition bead) that is disposed around an electrical bridge wire and positioned next to a primer explosive charge (such as lead azide or some other sensitive primary explosive). In some detonators, a booster charge of a secondary explosive (such as RDX, PETN, HMX, HNS or PYX, etc.) is arranged in a serial relationship with the primer charge to be detonated.

The electric detonator detonates an explosive detonating cord (detcord) which, in turn, sets off the charge(s) carried by the gun, once the tool is positioned at a desired depth location in a wellbore.

One practice in the industry is for an end user to purchase perforating guns in an unassembled or partially assembled condition and transport these to the oil well site. One reason for this is that the configuration of a perforating gun (spacing and number of charges, gun length and diameter, number of gun housings to be strung together, etc.) varies from wellbore to wellbore. Oil well sites are often in locations remote from assembly shops. For safety reasons, the shaped charges are transported separate from the detonating devices so that if the detonating devices were accidentally discharged, the shaped charge perforating units would not be detonated in turn.

A practice in the industry is thus to complete assembly and arm a gun on-site. A detonator is connected to an electrical conductor and then grounded to the gun housing. The detonating cord (previously strung between charges mounted on a charge holder and installed in the gun housing), an end of which sticks out of an end of the gun housing is clamped to the detonator or the detonator is slid axially onto the detonating cord. The detonator is inserted into the end of the gun housing, which can be either the top or bottom end of the gun. An end cap is then sealingly fastened to the end of the gun with the electrical conductor connecting the detonator and surface power source being strung through the cap, and/or through the gun, provision being made to seal the passage by which the conductor emerges from the gun to preclude entry of well fluids into the gun housing. As mentioned above, an alternative arrangement includes a booster.

In the context of this industry practice, the possibility exists of premature detonation of gun components during arming of the gun. In arrangements in which the detonator is directly connected to the detonating cord, it is possible to kink the detonating cord as the detonator is pushed into the gun housing and the sealing cap screwed onto the gun housing. In arrangements in which there is a booster attached to the detonating cord, it is possible to crush the booster. It is thus possible to short the wires when replacing the sealing cap in this manner.

This situation, which can lead to premature actuation, or unintended detonation, is clearly a hazard to the persons charged with gun assembly. While safe arm devices exist, many are designed to operate outside the practice of arming a gun on-site to meet the needs of a particular wellbore. It is in the context of this practice that the present invention presents a solution.

SUMMARY OF THE INVENTION

The invention includes a safety arming device for an underground well tool having an explosive charge mounted in a longitudinal housing. In one embodiment, the device includes:

- a hollow member for connection at an end of the housing, the member having an outer wall which defines a window to permit lateral insertion therethrough of a detonator into an operable position in the member when the member is connected to the housing; and
- a sealing member for mounting on the hollow member in sealing engagement therewith, so as to preclude ingress of liquids into the member through the window.

The sealing member of the device can be a hollow sleeve longitudinally movable with respect to the hollow member between an open position and a closed position, wherein:

- in the open position, the sleeve is located to permit access to the window for said insertion of the detonator therethrough, and in the closed position, the sleeve is in said sealing engagement with the hollow member.

The hollow member can be provided with threads at a first longitudinal end thereof and the sleeve is provided with threads for engagement of the threads of the hollow member to secure the sleeve in the closed position.

The sealing engagement can be provided by first and second circumferential seals located between the sleeve and hollow member, the seals being positioned longitudinally on either side of the window.

The hollow member can be adapted to be connected directly to the gun housing.

The hollow member can include threads for threaded connection at said end of the housing.

In another aspect, the invention provides a safety arming device for an underground well tool having an explosive charge mounted in a tubular longitudinal housing, the charge being actuatable by a detonator connected thereto by a detonation cord. The device can include:

a first sleeve having a wall defining a sleeve interior, the sleeve being adapted to be sealingly affixed to the tubular housing, wherein the wall has an aperture therein sized to permit lateral insertion therethrough of the detonator into the sleeve interior and, when the sleeve and housing are connected, the sleeve interior is in communication with an interior of the housing containing the charge; and a second sleeve, axially moveable with respect to the first sleeve, between an open position and a closed position; wherein, in the open position, the second sleeve is located to provide clearance for the detonator to be inserted through the aperture into the interior of the first sleeve, and in the closed position, the second sleeve is in sealing engagement with the first sleeve to preclude ingress of liquids into the sleeve interior through said aperture.

In another embodiment, the invention is a safety arming device for an underground well tool having an explosive charge mounted in a tubular longitudinal housing, the charge being actuatable by a detonator in operable connection with a booster connected to the charge by a detonation cord. In this embodiment, the device includes:

a first sleeve having a wall defining a sleeve interior, the sleeve being adapted to be sealingly affixed to the tubular housing, wherein:

the wall has an aperture therein sized to permit lateral insertion therethrough of the detonator into the sleeve interior;

the wall defines an interior sleeve portion for receipt of the booster therein to locate the booster in operable proximity to the detonator when the booster and cord are connected to each other; and a second sleeve, axially moveable with respect to the first sleeve, between an open position and a closed position; wherein:

in the open position, the second sleeve is located to provide clearance for the detonator to be inserted through the aperture into the interior of the first sleeve, and in the closed position, the second sleeve is in sealing engagement with the first sleeve to preclude ingress of liquids into the sleeve interior through said aperture.

The second sleeve can be external of the first sleeve and be of substantially circular cross section; and the first sleeve can include external first threads and the second sleeve includes internal second threads, the first and second threads being mutually threadingly engageable for securing the second sleeve in the closed position.

The first sleeve can include first and second seals disposed around an exterior surface thereof located longitudinally on first and second sides, respectively, of the aperture and to be in abutting contact with an interior surface of the second sleeve when in the second position so as to provide said sealing engagement. There can be a plurality of said first seals and a plurality of said second seals.

In another aspect, the present invention is a safety arming device for an underground perforation gun having an explosive charge mounted in a tubular housing having a major longitudinal axis, the charge being actuatable by a detonator connected thereto by a detonation cord. The device includes:

a hollow inner sleeve having threads at a first end for threaded connection to a threaded end of the housing such that respective interiors of the housing and sleeve are in communication with each other;

a hollow outer sleeve disposed around the inner sleeve, axially moveable between a first position distal to the first end of the inner sleeve and a second position proximal to the first end of the inner sleeve; wherein:

the inner sleeve includes a tubular wall having an aperture therein, accessible when the outer sleeve is in the distal position, the aperture being sized to permit lateral insertion therethrough of the detonator into the interior of the inner sleeve; and the tubular wall of the inner sleeve has external threads located axially between the aperture and the proximal end thereof and an interior surface of the outer sleeve is threaded at a proximal end thereof for threaded engagement of the external threads of the inner sleeve, to secure the outer sleeve in the second position;

at least a first seal disposed around the exterior of the inner sleeve, located axially between the aperture and the external threads of the inner sleeve;

at least a second seal disposed around the exterior of the inner sleeve, located axially between the aperture and the distal end of the inner sleeve; and wherein:

when the outer sleeve is secured in the second position, the seals are in abutting contact with the exterior surface of inner surface and interior surface of the outer sleeve so as to preclude ingress of liquid into the interior of the inner sleeve.

In another aspect, the invention is a safety arming device for an underground well tool having an explosive charge mounted in a tubular housing having a major longitudinal axis, the charge being actuatable by a detonator in operable connection with a booster connected to the charge by a detonation cord. The device includes:

a hollow inner sleeve having threads at a first end for threaded connection to a threaded end of the housing, such that respective interiors of the housing and sleeve are in axial alignment with each other, the sleeve having an internal wall defining a first zone for receipt of the booster therein;

a hollow outer sleeve disposed around the inner sleeve, axially moveable between a first position distal to the first end of the inner sleeve and a second position proximal to the first end of the inner sleeve; wherein:

the inner sleeve includes a tubular wall having an aperture therein, accessible when the outer sleeve is in the distal position, the aperture being sized to permit lateral insertion therethrough of the detonator into a second zone of the interior of the inner sleeve, to permit spaced apart positioning of the detonator and booster in axial alignment with each; and the tubular wall of the inner sleeve has external threads located axially between the aperture and the proximal end thereof and an interior surface of the outer sleeve is threaded at a proximal end thereof for threaded engagement of the external threads of the inner sleeve, to secure the outer sleeve in the second position;

at least a first seal disposed around the exterior of the inner sleeve, located axially between the aperture and the external threads of the inner sleeve;

at least a second seal disposed around the exterior of the inner sleeve, located axially between the aperture and the distal end of the inner sleeve; and wherein:

when the outer sleeve is secured in the second position, the seals are in abutting contact with the exterior surface of inner surface and interior surface of the outer sleeve so as to preclude ingress of liquid into the interior of the inner sleeve.

A safety arming device of the invention can includes a joining member for connecting the hollow member to the gun housing, the joining member having an aperture therethrough so as to permit communication between an interior of the housing and an interior of the hollow member for passage of the detonator cord therethrough.

The hollow member can define an aperture dimensioned to receive a detonator therein, so as to be positioned in axial alignment with a booster received with the aperture of the joining member.

The invention also includes a method of installing a safety arming device on a longitudinal underground perforating gun. The method includes steps of:

providing a hollow member for connection at an end of a housing of the gun, wherein the hollow member comprises an outer wall which defines a window dimensioned to permit insertion therethrough of a first detonator into an interior of the member;

providing a sealing member for mounting to the hollow member in sealing engagement therewith, so as to preclude ingress of liquids into the member through the window; and installing the hollow member to the housing such that the window is positioned to permit lateral insertion of the detonator therethrough into the interior of the hollow member and with the interior of the housing positioned (i) to receive therein a first end of a detonating cord having a second end connected to a charge within the housing therein, or (ii) to permit positioning of the detonator therein with respect to a booster connected to a said first end of the detonating cord for actuating the booster by the installed detonator.

The method can be conducted with a sealing member that includes a hollow sleeve longitudinally movable with respect to the installed hollow member between an open position and a closed position, wherein:

in the open position, the sleeve is located to permit access to the window for said insertion of the detonator therethrough, and in the closed position, the sleeve is in said sealing engagement with the hollow member.

The method can be carried out where the hollow member is provided with threads at a first longitudinal end thereof and the sleeve is provided with threads for engagement of the threads of the hollow member to secure the sleeve in the closed position.

The said sealing engagement can be provided by first and second circumferential seals located between the sleeve and hollow member, the seals being positioned longitudinally on either side of the window.

The hollow member can further include means for connecting the member to a gun delivery system, at a distal end of the member with respect to the gun housing.

The connecting means can be provided by threads or another connecting means suitable for the purpose, as would be readily understood by the skilled person.

The hollow member can include an opening in a wall thereof, the opening being sealable against ingress of well fluids thereinto, for installing a conductive wire therethrough to electrically connect the detonator to an above-ground power source.

Installing the hollow member on the housing can include threadingly engaging threads of the member with threads of the housing.

The gun can include a second detonator connected to a said first end of the detonating cord, and the method can further comprise the steps of:

providing an apertured member having an aperture therethrough; and prior to installing the hollow member on the housing, installing a first longitudinal end of the apertured member to the end of the housing with the aperture extending between longitudinal ends of the apertured member and passing a free end of the first end of the detonating cord connected to the second detonator through the aperture to permit connection thereof to the first detonator.

The invention also includes a method of arming an underground perforating gun having a longitudinal housing. The method can include the steps of:

mounting a hollow member at an end of a housing of the gun, wherein the hollow member comprises an outer wall which defines a window dimensioned to permit insertion therethrough of a first detonator into an interior of the member, and wherein the interior of the hollow member is positioned (i) to receive therein a first end of a detonating cord having a second end connected to a charge within the housing therein, or (ii) to permit positioning of the detonator therein with respect to a booster connected to a said first end of the detonating cord for actuating the booster by the installed detonator;

inserting the detonator through the window to install the detonator in the interior of the hollow member and:

connecting the first end of the detonating cord thereto, or positioning the detonator with respect to a booster connected to the first end of the detonating cord for actuating the booster by the installed detonator; and securing a sealing member to the hollow member in sealing engagement therewith, so as to preclude ingress of liquids into the member through the window.

The method can also include connecting the detonator to an electrically conductive wire connected to a power source.

The sealing member can include a hollow sleeve longitudinally movable with respect to the installed hollow member between an open position and a closed position, wherein:

in the open position, the sleeve is located to permit access to the window for said insertion of the detonator therethrough, and in the closed position, the sleeve is in said sealing engagement with the hollow member.

The hollow member can be provided with threads at a first longitudinal end thereof and the sleeve is provided with threads for engagement of the threads of the hollow member to secure the sleeve in the closed position and securing the sealing member to the hollow member includes mutually engaging the respective threads of the hollow and sealing members.

The sealing engagement can be provided by first and second circumferential seals located between the sleeve and hollow member, the seals being positioned longitudinally on either side of the window.

The method can include connecting the hollow member to a gun delivery system.

Connecting the hollow member to the gun delivery system can include threadingly engaging threads of the hollow member to counterpart threads of an element of the gun delivery system.

The hollow member can include an opening in a wall thereof, the opening being sealable against ingress of well fluids thereinto, and comprising the further steps of installing a conductive wire through the opening and electrically connecting the detonator to an above-ground power source.

Installing the hollow member on the housing can include threadingly engaging threads of the member with threads of the housing.

The gun can include a second detonator connected to a said first end of the detonating cord, and the method further comprises the steps of:

providing an apertured member having an aperture therethrough; and prior to installing the hollow member on the housing, installing a first longitudinal end of the apertured member to the end of the housing with the aperture extending between longitudinal ends of the apertured member and passing a free end of the first end of the detonating cord connected to the second detonator through the aperture to permit said connecting thereof to the first detonator.

The invention is also a method of manufacturing a safety arming device for an underground well tool having an explosive charge mounted in a longitudinal housing. The method includes the steps of:

manufacturing a hollow member for connection at an end of the housing with an outer wall;

contouring the wall to define a window to permit lateral insertion therethrough of a detonator into an operable position in the member when the member is connected to the housing; and manufacturing a sealing member for mounting on the hollow member in sealing engagement therewith, so as to preclude ingress of liquids into the member through the window.

BRIEF DESCRIPTION OF THE DRAWINGS

The invention is illustrated by way of example, with reference to the accompanying drawings, in which.

DETAILED DESCRIPTION OF PREFERRED EMBODIMENT

Figures 1A, 1B:
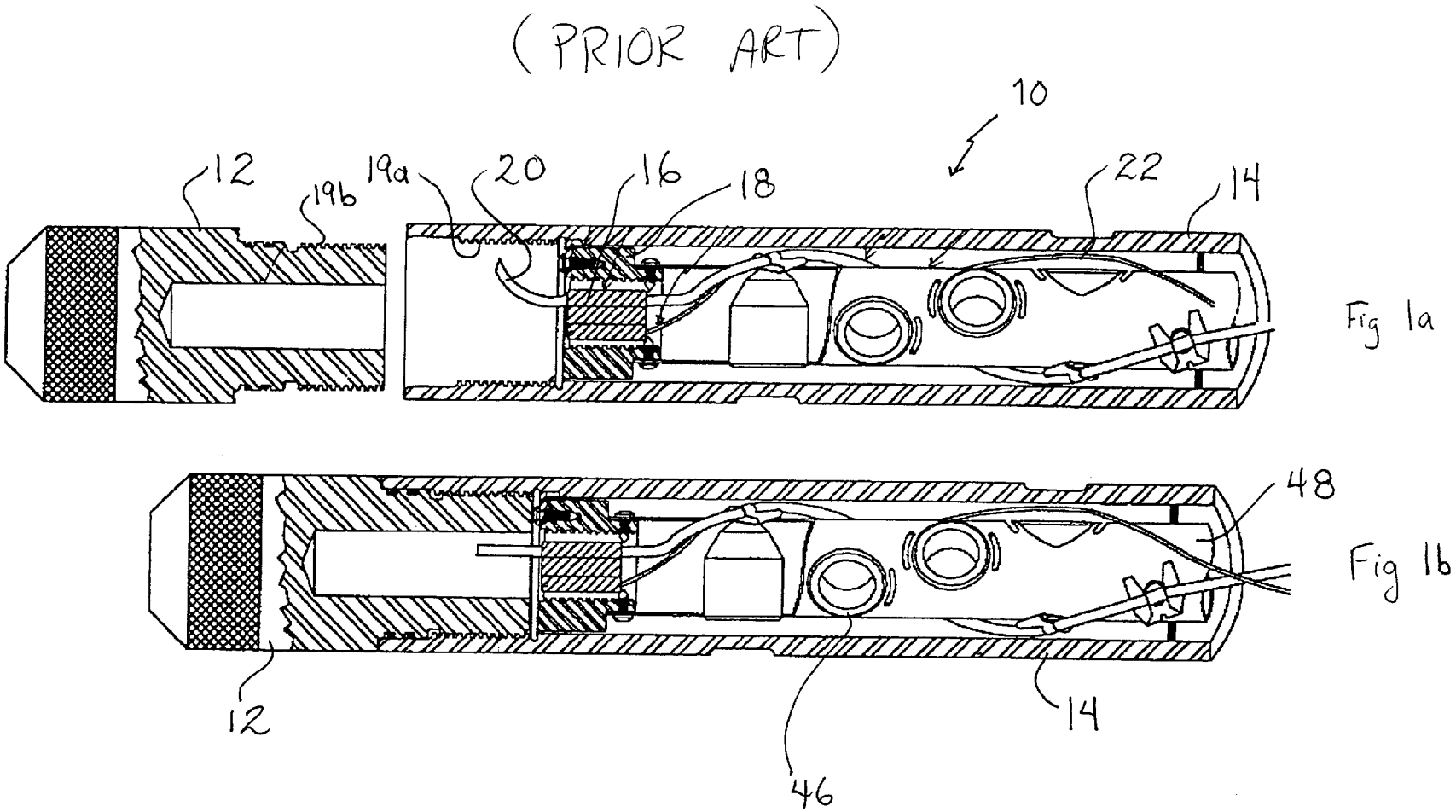
Fig 1b (PRIOR ART)
FIGS. 1*a* and 1*b* illustrate a prior art arming arrangement of the prior art, in disassembled and assembled conditions, respectively.

Turning to the drawings, FIGS. 1*a* and 1*b* illustrate a prior art approach in which a gun 10 has an end housing 12 mounted to the bottom of its housing 14. The gun includes a block detonator 16 mounted within end fitting 18 installed within the gun housing. In this case, the detonator is located at the bottom end of the gun and detonator cord 20 and electrical wire 22, connected to a surface power source, run through the hollow interior of gun housing 14. End housing 12 has a hollow interior for receipt therein of a detonator. A typical housing has an outer diameter of up to about 8 inches and its outer wall can be, for example, between about 0.75 cm (0.3 inches) and about 1 cm (⅜ inches) thick.

A particular safety arming device 24 of the present invention is now described with reference to the remainder of the drawings. This illustrated device would most typically be connected intermediate a delivery device and a perforation gun for use in a wellbore, that is, at the upper end of a gun. Delivery devices and perforating guns are known in the art. A typical perforating gun 10 is illustrated in FIGS 1*a* and 1*b*. Prior art guns are described in Canadian Patent Nos. 360,244, issued Sep. 1, 1936 and 514,177, issued Jan. 28, 1955. Of course, the arming device and gun must be suited with compatible means for connection to each other. Thus, device 24 can be threadingly connected to a gun housing having suitable external threads. Further, the threading arrangement could be reversed, the external threads being on the arming device and internal threads being on the gun housing as in the gun housing illustrated in FIGS. 1*a* and 1*b*. Delivery devices, such as a suspension cable spooled on a winch, or tubing, or coiled tubing, are well known and are not described further here.

Figure 2:
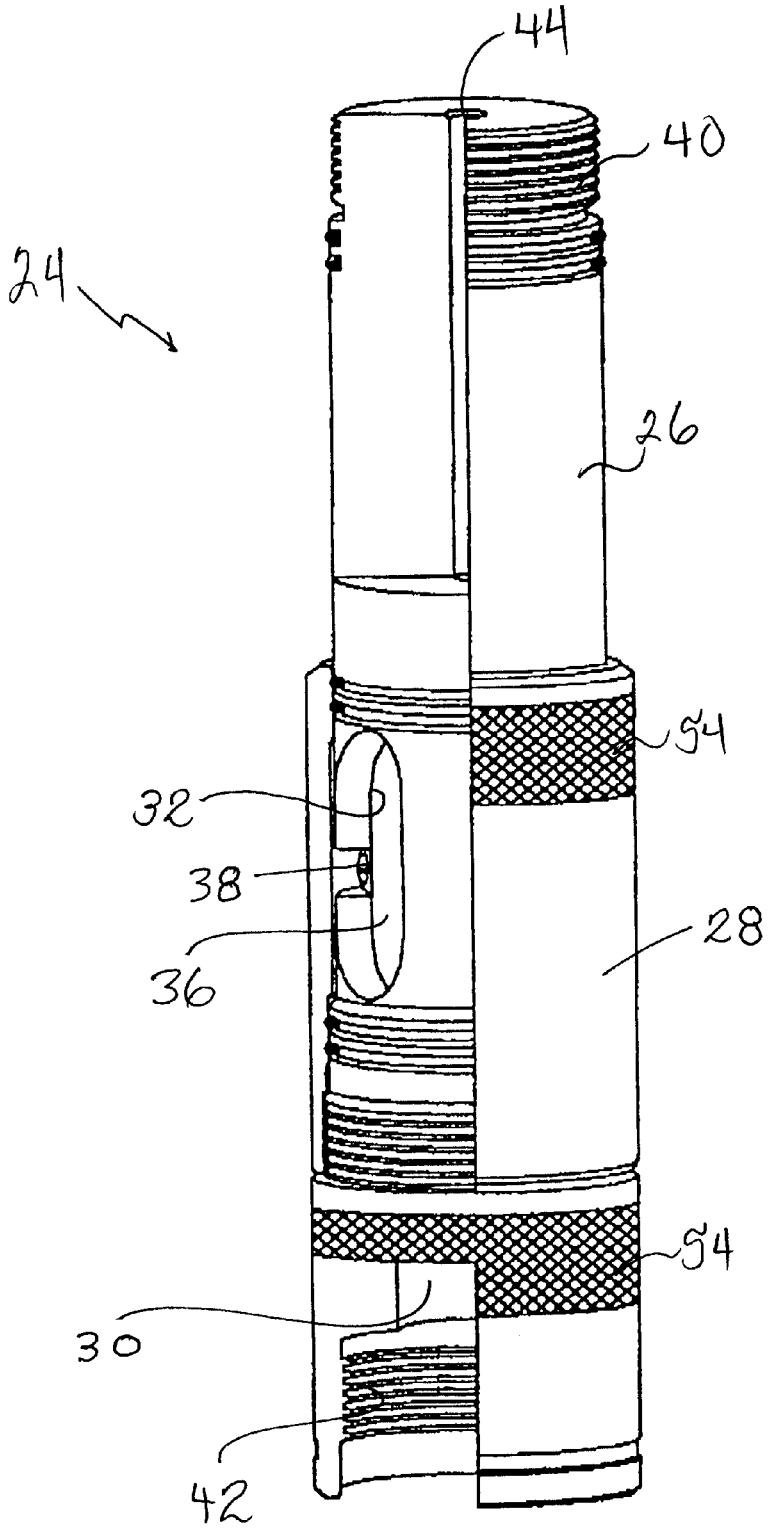
FIG. 2 is a partial sectional view of a safety arming device of the present invention, in a closed position.
Figure 4:
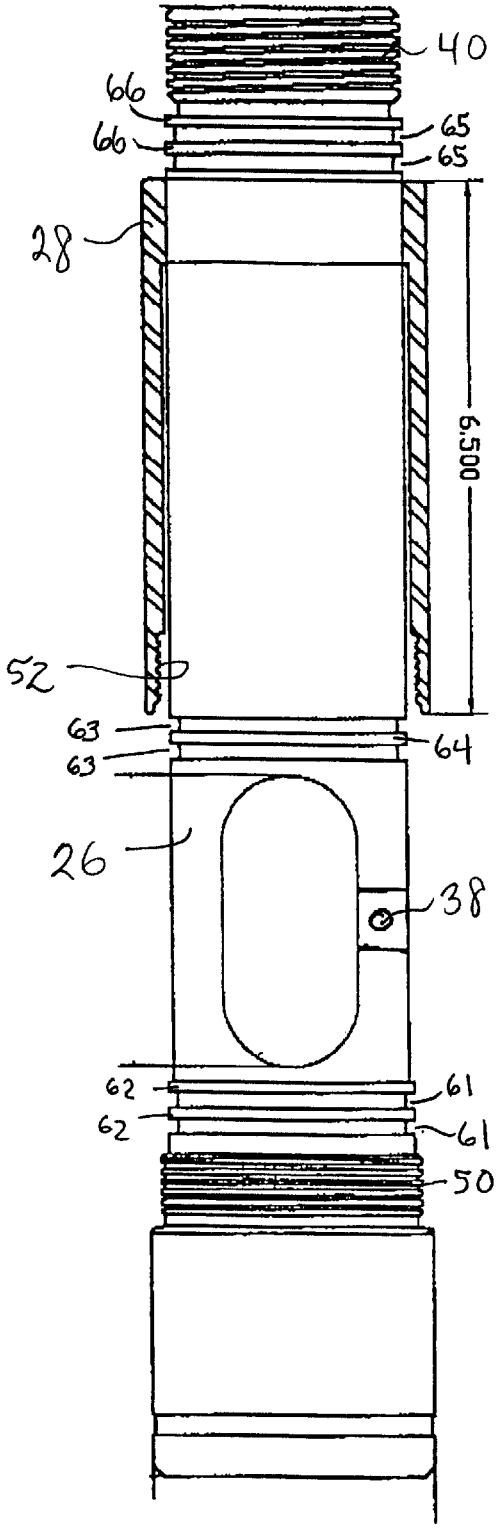
FIG. 4 is a view similar to that of FIG. 3 in which the device is in an open position.
Figure 3:
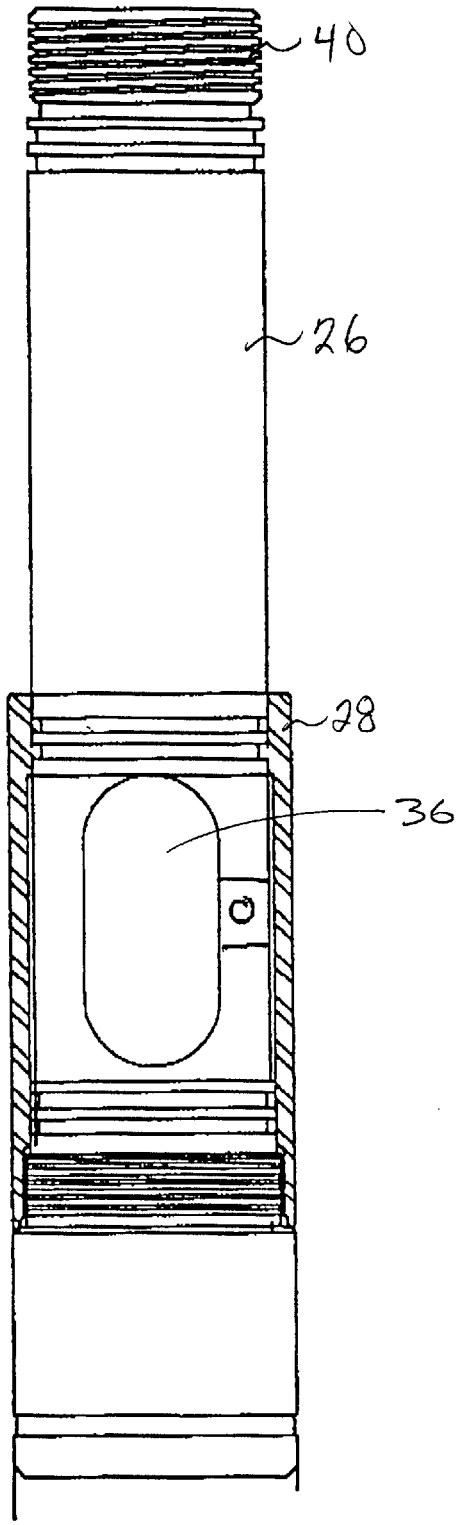
FIG. 3 is an elevational view in partial section of the FIG. 2 device in the closed position, viewed from the left hand side of the FIG. 2 view, the location of the grounding screw having been shifted.
Figure 6:
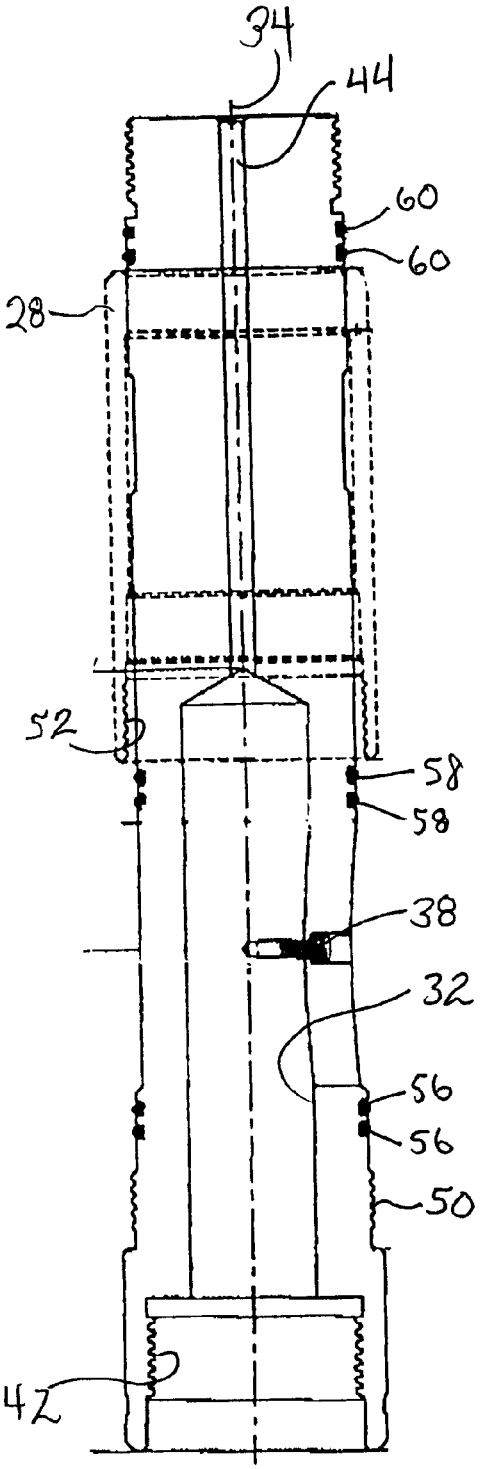
FIG. 6 is a view similar to that of FIG. 5 in which the device is in an open position.
Figure 5:
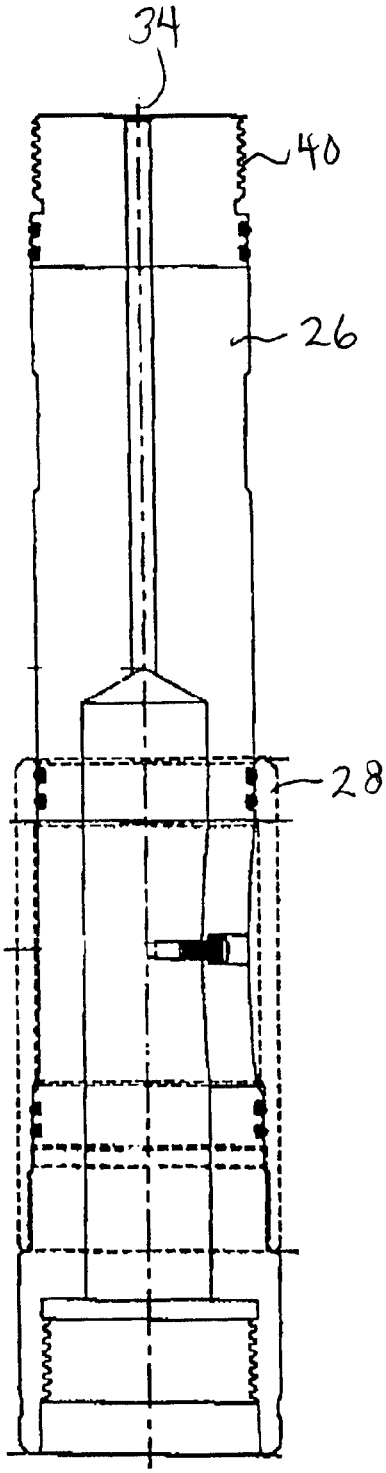
FIG. 5 is an elevational, sectional-type view of the FIG. 2 device in the closed position, viewed from the rear of the FIG. 2 view and at 90° rotation with respect to the FIG. 3 view.

Safety arming device 24 includes inner mandrel member 26 and outer sleeve 28. Inner mandrel member, i.e., inner sleeve 26 includes a hollow interior 30 defined by surrounding wall 32. Outer sleeve 28 is movable parallel to central axis 34, i.e., is axially movable, between the open position shown in FIG. 4 and the closed position shown in FIGS. 2 and 3. The inner sleeve includes aperture 36 defined in its side wall and grounding screw 38. The inner member includes external threads 40 at what would typically be its "top" end, and inner threads 42, at the opposite "bottom" end of the device. The external/internal arrangement of the threads can be reversed. Hole 44 extends through the upper part of inner member 26 to provide communication between inner sleeve interior 30 and the exterior of the device.

Device 24 is typically installed and used as follows. Charges, e.g., shaped charges 46, are installed within longitudinal tubular housing 14 of a gun such as gun 10. Typically, the charges are mounted on charge holder 48, detonator cord 20 is strung from charge to charge, and the assembled subunit is inserted into the gun housing with a free end of the detonation cord protruding from the "top" end of the gun. Of course, the orientation of the gun can be reversed with the arming device installed at the bottom end of a gun housing. Means is provided at the top and bottom ends of the gun for axially securing the holder within the housing, as for example by fitting 18 illustrated in FIGS. 1*a* and 1*b*.

Device 24 is screwed onto the top end of the gun housing by means of threads 42 which are configured to threadingly mate with complementary external counterparts at the top end (in an alternative arrangement, at the bottom end) of the gun housing. It will be noted that if device 24 were to be used with the gun illustrated in FIGS. 1*a* and 1*b*, then threads 42 could be located on the exterior of sleeve 26, rather than on the interior. Alternatively, threads 19*a* on the gun housing (which mate with threads 19*b* of cap 12 of the FIG. 1 device) could be located on an external surface of the housing 14 to mate with threads 42 of the device 24. Interior hollow portions of the gun housing and inner sleeve 26 are in communication with each other and so, with outer sleeve 28 in its "open position" (FIG. 4) the free end of the detonation cord is drawn through the interior of the sleeve and through aperture 36 to the exterior of the device.

An electrical conductor is passed through aperture 44 to the interior of sleeve 26, drawn out of the interior through aperture 36 and connected to detonator 16. A grounding wire is connected between the detonator and grounding screw 38. As a final stage of the arming step, the free end of the detonation cord is connected to the detonator and the detonator and connected wire and detonating cord are inserted laterally (with respect to the longitudinal axis of the gun) by means of aperture 36 into the interior 30 of inner sleeve 26. Outer sleeve 28 is then moved along the longitudinal axis of the assembly. The outer sleeve is secured in the closed position by appropriate rotation with respect to inner sleeve 26 to engage mating threads 50 (inner member) and 52 (outer sleeve). The gun assembly is then sealingly connected by means of external threads 40 to a delivery device for introduction into a wellbore.

Appropriate knurling 54 is provided on the external surfaces of members 26, 28 to assist in rotation of components (e.g., outer sleeve 28) with respect to components to which they are to be threadingly secured.

Device 24 includes seals 56, 58, 60. Seals 56 are located axially intermediate threads 50 and window 36. Seals 58 are located axially intermediate window 36 and the top end of inner member 26. The seals are O-rings of a resilient (e.g. thermoplastic) material suitable for sealing against entry of oil and water and other liquids encountered in a wellbore. Seals 56 are seated in grooves 61 defined in part between ridges 62. Seals 58 are seated in grooves 63 defined in part by ridge 64. Seals 60 are seated in grooves 65 defined in part by ridges 66. When outer sleeve 28 is threadingly secured in its closed position, seals 56, 58, which are disposed to entirely surround the inner member, abut surfaces of inner member 26 and outer member 28 to seal against the entry of liquids into the interior of the gun assembly through window 36. Other appropriate seals are provided as needed so as to preclude entry of liquids into the interior of the gun assembly as a whole when submerged in the liquids of the wellbore. For example, seals 60 serve to protect against ingress of water through the joint between member 26 and the connection to the delivery device (not illustrated).

Figure 7:
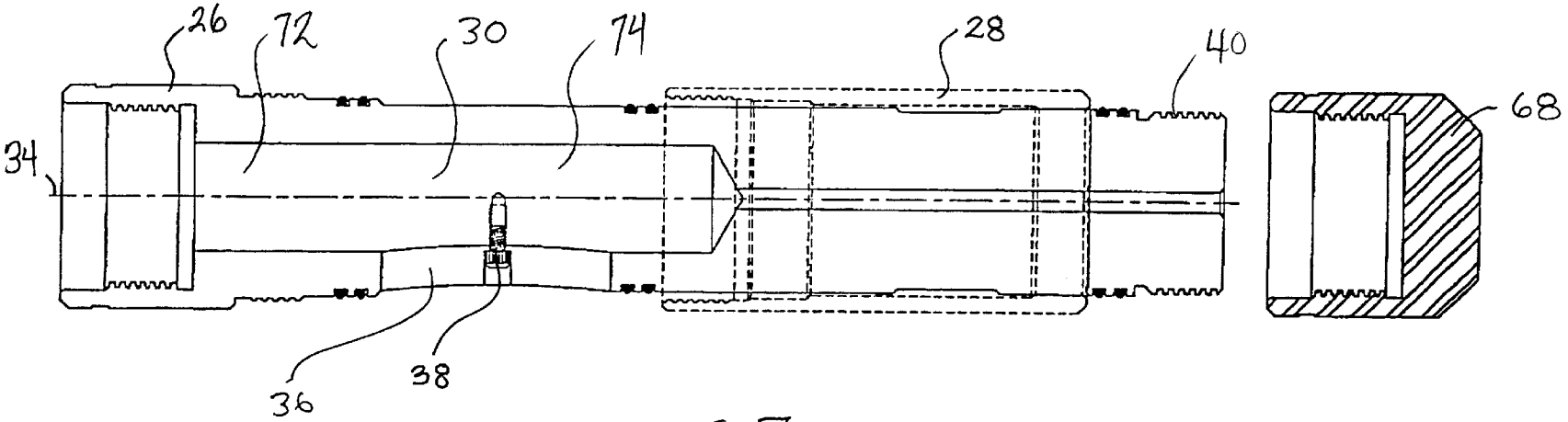
FIG. 7 is a view similar to that of FIG. 6 illustrating an additional end cap, for assembly of the device at a lower end of a perforating gun.

It will be appreciated, that the foregoing installation describes one possible configuration of the safety arming device within a gun assembly. For example, the assembly could be installed at the lower end of a gun housing, in which case the nominal "top" end of the device as described above, would become the bottom end. In such case, if the safety arming device were the lower most element of the gun assembly, then the electrical wire would run through the gun housing and means would have to be provided to seal hole 44 against passage of wellbore liquids. Typically, cap 68 (FIG. 7) would be screwed onto threads 40.

It is possible to incorporate the device of the present invention integrally into the housing of a gun, eliminating the need for attachment of a separate mandrel 26. Of course, this approach removes the advantage of using the present invention in the arrangement illustrated in FIGS. 8 and 9.

Figure 8:
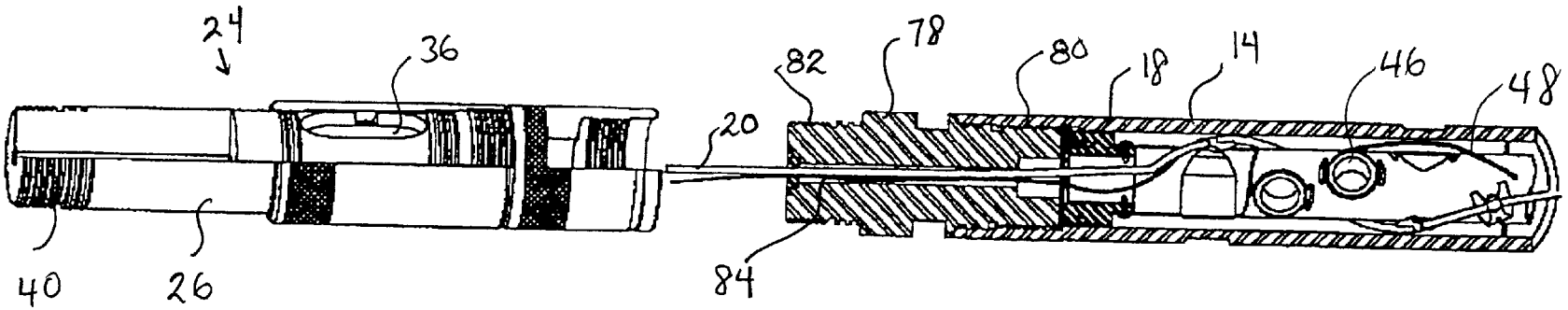
FIG. 8 is a view similar to that of FIG. 7 illustrating incorporation a joining member between the safety arming device and gun housing.
Figure 9:
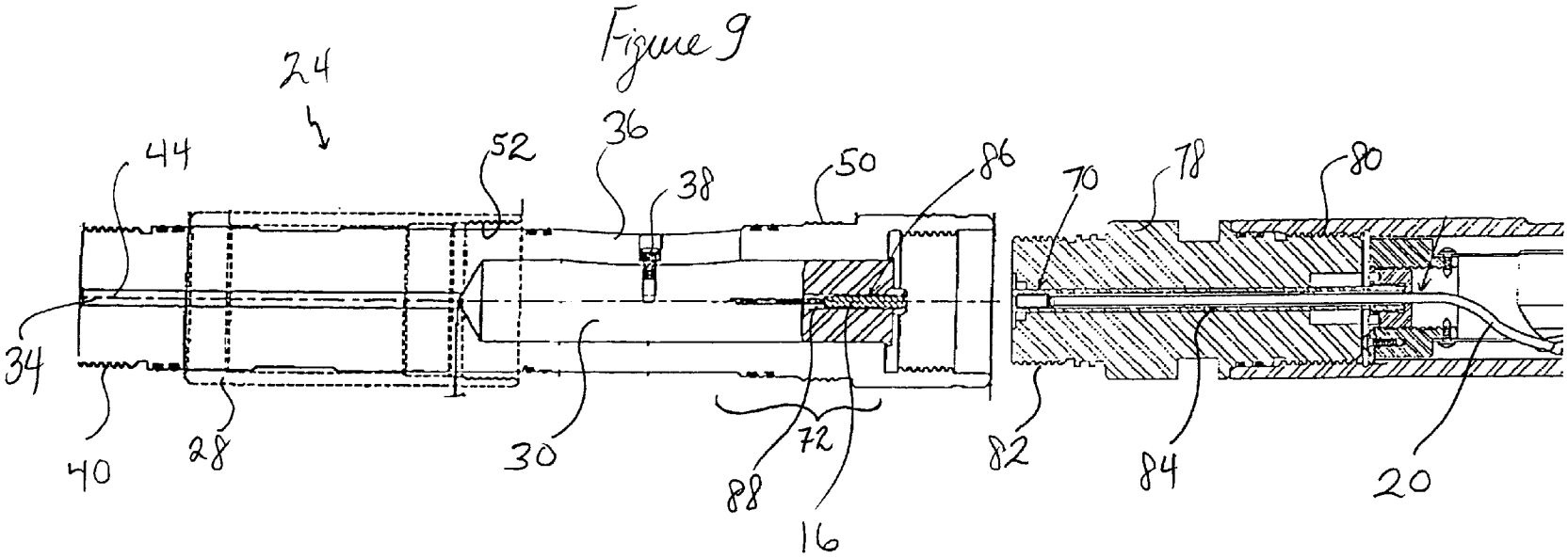
FIG. 9 is a partial sectional exploded view of the safety arming device in conjunction with a joining member and having a booster installed therein.

Turning to FIGS. 8 and 9, an intermediate joining member 78 for connection of the gun housing 14 and safety arming device 24 is illustrated. Joining member 78 includes externally threaded ends 80, 82 for attachment to the gun housing and safety arming device, respectively. Running longitudinally, from end to end of joining member 78, is a central aperture 84. Central aperture 84 is in communication with the interiors of the gun housing and the mandrel (inner sleeve) 26 of the safety device.

In the case of the arrangement shown in FIG. 8, joining member 78 permits union of the gun housing and safety device where both of the gun housing and arming device have internal threads. As can be seen in FIG. 8, detonator cord 20 runs through the aperture 84 emerging to be connected to a detonator.

Perforation guns often include a booster as part of the actuating system. One arrangement is illustrated in FIG. 9. Here, block 86 is installed in device 24. Block 86 has a longitudinal aperture 88 in direct axial communication with aperture 84 of the joining member. Booster 70 is connected to the free end of the detonator cord and positioned at the outer end of the aperture 84. The detonator is installed in aperture 88 and positioned so that when sleeve 26 is threadingly installed onto joining member 78, the detonator and booster are axially spaced apart an appropriate distance for proper operation of the device. Access is provided through window 36 for connection to electrical cord 22 and for connection of the grounding wire by screw 38.

It is also possible to simply incorporate booster 70 into the inner sleeve 26 of the safety arming device described above, with the detonator and booster spaced from and in axial alignment with each other. Booster 70 is thus positioned in zone 72 of the hollow interior of mandrel 26 and the detonator positioned appropriately in zone 74. The invention of the present invention may be used with oilfield tools other than perforating guns. Other tools employing an electric detonator and detonating cords include explosive cutting tools having an annular shaped explosive charge which produces an omnidirectional planar cutting jet. Wireline chemical cutters similarly employ electric detonators for igniting a gas-producing propellant composition to discharge pressured jets of extremely-dangerous halogen fluoride chemicals against an adjacent tubing or casing wall. Typical explosive backoff tools use an electric detonator for setting off a bundled detonating cord. It is, of course, obvious that each of these various underground tools could benefit from the incorporation thereinto of the present invention.

The contents of all documents referred to in this specification are incorporated herein by reference, each in its entirety.

Sufficient description of the invention having been given for a skilled person to make and use the invention, including the preferred embodiment, the scope of protection for which protection is sought is defined by the appended claims, although the scope of protection sought may be broadened during prosecution of the application if the prior art warrants such in view of the foregoing description.

What is claimed is:

1. A safety arming device for an underground well tool having an explosive charge mounted in a longitudinal housing, the device comprising:

a hollow member for connection at an end of the housing, the member having an outer wall which defines a window to permit lateral insertion therethrough of a detonator into an operable position in the member when the member is connected to the housing; and a sealing member for mounting on the hollow member in sealing engagement therewith, so as to preclude ingress of liquids into the member through the window.

2. The device of claim 1 wherein, the sealing member comprises a hollow sleeve longitudinally movable with respect to the hollow member between an open position and a closed position, wherein:

in the open position, the sleeve is located to permit access to the window for said insertion of the detonator therethrough, and in the closed position, the sleeve is in said sealing engagement with the hollow member.

3. The device of claim 2 wherein the hollow member is provided with threads at a first longitudinal end thereof and the sleeve is provided with threads for engagement of the threads of the hollow member to secure the sleeve in the closed position.

4. The device of claim 3 wherein said sealing engagement is provided by first and second circumferential seals located between the sleeve and hollow member, the seals being positioned longitudinally on either side of the window.

5. The device of claim 1 wherein the hollow member is adapted to be connected directly to the gun housing.

6. The device of claim 1 wherein the hollow member includes threads for threaded connection at said end of the housing.

7. A safety arming device for an underground well tool having an explosive charge mounted in a tubular longitudinal housing, the charge being actuatable by a detonator connected thereto by a detonation cord, the device comprising:

a first sleeve having a wall defining a sleeve interior, the sleeve being adapted to be sealingly affixed to the tubular housing, wherein the wall has an aperture therein sized to permit lateral insertion therethrough of the detonator into the sleeve interior and, when the sleeve and housing are connected, the sleeve interior is in communication with an interior of the housing containing the charge; and a second sleeve, axially moveable with respect to the first sleeve, between an open position and a closed position; wherein, in the open position, the second sleeve is located to provide clearance for the detonator to be inserted through the aperture into the interior of the first sleeve, and in the closed position, the second sleeve is in sealing engagement with the first sleeve to preclude ingress of liquids into the sleeve interior through said aperture.

8. A safety arming device for an underground well tool having an explosive charge mounted in a tubular longitudinal housing, the charge being actuatable by a detonator in operable connection with a booster connected to the charge by a detonation cord, the device comprising:

a first sleeve having a wall defining a sleeve interior, the sleeve being adapted to be sealingly affixed to the tubular housing, wherein:

the wall has an aperture therein sized to permit lateral insertion therethrough of the detonator into the sleeve interior;

the wall defines an interior sleeve portion for receipt of the booster therein to locate the booster in operable proximity to the detonator when the booster and cord are connected to each other; and a second sleeve, axially moveable with respect to the first sleeve, between an open position and a closed position; wherein:

in the open position, the second sleeve is located to provide clearance for the detonator to be inserted through the aperture into the interior of the first sleeve, and in the closed position, the second sleeve is in sealing engagement with the first sleeve to preclude ingress of liquids into the sleeve interior through said aperture.

9. The device of claim 7, wherein:

the second sleeve is external of the first sleeve and is of substantially circular cross section; and the first sleeve includes external first threads and the second sleeve includes internal second threads, the first and second threads being mutually threadingly engageable for securing the second sleeve in the closed position.

10. The device of claim 9 wherein said first sleeve includes first and second seals disposed around an exterior surface thereof located longitudinally on first and second sides, respectively, of the aperture and to be in abutting contact with an interior surface of the second sleeve when in the second position so as to provide said sealing engagement.

11. The device of claim 10 wherein there is a plurality of said first seals and a plurality of said second seals.

12. A safety arming device for an underground perforation gun having an explosive charge mounted in a tubular housing having a major longitudinal axis, the charge being actuatable by a detonator connected thereto by a detonation cord, the device comprising:

a hollow inner sleeve having threads at a first end for threaded connection to a threaded end of the housing such that respective interiors of the housing and sleeve are in communication with each other;

a hollow outer sleeve disposed around the inner sleeve, axially moveable between a first position distal to the first end of the inner sleeve and a second position proximal to the first end of the inner sleeve; wherein:

the inner sleeve includes a tubular wall having an aperture therein, accessible when the outer sleeve is in the distal position, the aperture being sized to permit lateral insertion therethrough of the detonator into the interior of the inner sleeve; and the tubular wall of the inner sleeve has external threads located axially between the aperture and the proximal end thereof and an interior surface of the outer sleeve is threaded at a proximal end thereof for threaded engagement of the external threads of the inner sleeve, to secure the outer sleeve in the second position;

at least a first seal disposed around the exterior of the inner sleeve, located axially between the aperture and the external threads of the inner sleeve;

at least a second seal disposed around the exterior of the inner sleeve, located axially between the aperture and the distal end of the inner sleeve; and wherein:

when the outer sleeve is secured in the second position, the seals are in abutting contact with the exterior surface of inner surface and interior surface of the outer sleeve so as to preclude ingress of liquid into the interior of the inner sleeve.

13. A safety arming device for an underground well tool having an explosive charge mounted in a tubular housing having a major longitudinal axis, the charge being actuatable by a detonator in operable connection with a booster connected to the charge by a detonation cord, the device comprising:

a hollow inner sleeve having threads at a first end for threaded connection to a threaded end of the housing, such that respective interiors of the housing and sleeve are in axial alignment with each other, the sleeve having an internal wall defining a first zone for receipt of the booster therein;

a hollow outer sleeve disposed around the inner sleeve, axially moveable between a first position distal to the first end of the inner sleeve and a second position proximal to the first end of the inner sleeve; wherein:

the inner sleeve includes a tubular wall having an aperture therein, accessible when the outer sleeve is in the distal position, the aperture being sized to permit lateral insertion therethrough of the detonator into a second zone of the interior of the inner sleeve, to permit spaced apart positioning of the detonator and booster in axial alignment with each; and the tubular wall of the inner sleeve has external threads located axially between the aperture and the proximal end thereof and an interior surface of the outer sleeve is threaded at a proximal end thereof for threaded engagement of the external threads of the inner sleeve, to secure the outer sleeve in the second position;

at least a first seal disposed around the exterior of the inner sleeve, located axially between the aperture and the external threads of the inner sleeve;

at least a second seal disposed around the exterior of the inner sleeve, located axially between the aperture and the distal end of the inner sleeve; and wherein:

when the outer sleeve is secured in the second position, the seals are in abutting contact with the exterior surface of inner surface and interior surface of the outer sleeve so as to preclude ingress of liquid into the interior of the inner sleeve.

14. The safety arming device of claim 1, further comprising a joining member for connecting the hollow member to the gun housing, the joining member having an aperture therethrough so as to permit communication between an interior of the housing and an interior of the hollow member for passage of the detonator cord therethrough.

15. The safety arming device of claim 14, wherein the hollow member defines an aperture dimensioned to receive a detonator therein, so as to be positioned in axial alignment with a booster received with the aperture of the joining member.

16. A method of installing a safety arming device on a longitudinal underground perforating gun, the method comprising the steps of:

providing a hollow member for connection at an end of a housing of the gun, wherein the hollow member comprises an outer wall which defines a window dimensioned to permit insertion therethrough of a first detonator into an interior of the member;

providing a sealing member for mounting to the hollow member in sealing engagement therewith, so as to preclude ingress of liquids into the member through the window; and installing the hollow member to the housing such that the window is positioned to permit lateral insertion of the detonator therethrough into the interior of the hollow member and with the interior of the housing positioned (i) to receive therein a first end of a detonating cord having a second end connected to a charge within the housing therein, or (ii) to permit positioning of the detonator therein with respect to a booster connected to a said first end of the detonating cord for actuating the booster by the installed detonator.

17. The method of claim 16, wherein:

the sealing member comprises a hollow sleeve longitudinally movable with respect to the installed hollow member between an open position and a closed position, wherein:

in the open position, the sleeve is located to permit access to the window for said insertion of the detonator therethrough, and in the closed position, the sleeve is in said sealing engagement with the hollow member.

18. The method of claim 17, wherein the hollow member is provided with threads at a first longitudinal end thereof and the sleeve is provided with threads for engagement of the threads of the hollow member to secure the sleeve in the closed position.

19. The method of claim 18, wherein said sealing engagement is provided by first and second circumferential seals located between the sleeve and hollow member, the seals being positioned longitudinally on either side of the window.

20. The method of claim 19, wherein the hollow member further comprises means for connecting the member to a gun delivery system, at a distal end of the member with respect to the gun housing.

21. The method of claim 19, where said connecting means is provided by threads.

22. The method of claim 20, wherein the hollow member includes an opening in a wall thereof, the opening being sealable against ingress of well fluids thereinto, for installing a conductive wire therethrough to electrically connect the detonator to an above-ground power source.

23. The method of claim 16 wherein installing the hollow member on the housing includes threadingly engaging threads of the member with threads of the housing.

24. The method of claim 18 wherein the gun includes a second detonator connected to a said first end of the detonating cord, and the method further comprises the steps of:

providing an apertured member having an aperture therethrough; and prior to installing the hollow member on the housing, installing a first longitudinal end of the apertured member to the end of the housing with the aperture extending between longitudinal ends of the apertured member and passing a free end of the first end of the detonating cord connected to the second detonator through the aperture to permit connection thereof to the first detonator.

25. A method of arming an underground perforating gun having a longitudinal housing, the method comprising the steps of:

mounting a hollow member at an end of a housing of the gun, wherein the hollow member comprises an outer wall which defines a window dimensioned to permit insertion therethrough of a first detonator into an interior of the member, and wherein the interior of the hollow member is positioned (i) to receive therein a first end of a detonating cord having a second end connected to a charge within the housing therein, or (ii) to permit positioning of the detonator therein with respect to a booster connected to a said first end of the detonating cord for actuating the booster by the installed detonator;

inserting the detonator through the window to install the detonator in the interior of the hollow member and:

connecting the first end of the detonating cord thereto, or positioning the detonator with respect to a booster connected to the first end of the detonating cord for actuating the booster by the installed detonator; and securing a sealing member to the hollow member in sealing engagement therewith, so as to preclude ingress of liquids into the member through the window.

26. The method of claim 25, comprising the further step of connecting the detonator to an electrically conductive wire connected to a power source.

27. The method of claim 25, wherein the sealing member comprises a hollow sleeve longitudinally movable with respect to the installed hollow member between an open position and a closed position, wherein:

in the open position, the sleeve is located to permit access to the window for said insertion of the detonator therethrough, and in the closed position, the sleeve is in said sealing engagement with the hollow member.

28. The method of claim 26, wherein the hollow member is provided with threads at a first longitudinal end thereof and the sleeve is provided with threads for engagement of the threads of the hollow member to secure the sleeve in the closed position and securing the sealing member to the hollow member includes mutually engaging the respective threads of the hollow and sealing members.

29. The method of claim 28, wherein said sealing engagement is provided by first and second circumferential seals located between the sleeve and hollow member, the seals being positioned longitudinally on either side of the window.

30. The method of claim 29, further comprising the step of connecting the hollow member to a gun delivery system.

31. The method of claim 30, wherein connecting the hollow member to the gun delivery system includes threadingly engaging threads of the hollow member to counterpart threads of an element of the gun delivery system.

32. The method of claim 31, wherein the hollow member includes an opening in a wall thereof, the opening being sealable against ingress of well fluids thereinto, and comprising the further steps of installing a conductive wire through the opening and electrically connecting the detonator to an above-ground power source.

33. The method of claim 32 wherein installing the hollow member on the housing includes threadingly engaging threads of the member with threads of the housing.

34. The method of claim 25 wherein the gun includes a second detonator connected to a said first end of the detonating cord, and the method further comprises the steps of:

providing an apertured member having an aperture therethrough; and prior to installing the hollow member on the housing, installing a first longitudinal end of the apertured member to the end of the housing with the aperture extending between longitudinal ends of the apertured member and passing a free end of the first end of the detonating cord connected to the second detonator through the aperture to permit said connecting thereof to the first detonator.

* * * * *